United States Patent [19]

Cox

[11] Patent Number: 4,460,105

[45] Date of Patent: Jul. 17, 1984

[54] SAFETY LATCH FOR HINGED LID

[76] Inventor: Jim R. Cox, 431 Debby St., Fallbrook, Calif. 92028

[21] Appl. No.: 421,085

[22] Filed: Sep. 22, 1982

[51] Int. Cl.[3] ..... B65D 43/24

[52] U.S. Cl. ..... 220/335; 217/60 C; 217/60 D

[58] Field of Search ..... 220/335; 217/60 B, 60 R, 217/60 C, 60 D, 60 F, 60 E, 61; 16/82

[56] References Cited

U.S. PATENT DOCUMENTS

| | | | |
|---|---|---|---|
| 70,597 | 11/1867 | Mora | 217/60 D |
| 81,477 | 8/1868 | Cohen | 217/60 E |
| 94,692 | 9/1869 | Roch | 217/60 E |
| 705,171 | 7/1902 | Walton | 217/60 D |
| 1,128,620 | 2/1915 | Munzner | 217/60 G X |
| 1,181,311 | 5/1916 | Huber et al. . | |
| 1,379,794 | 5/1921 | Ahlstrom | 217/60 D |
| 2,067,309 | 1/1937 | Wogaman | 217/60 G X |
| 2,544,611 | 3/1951 | Nottingham | 292/227 |
| 3,019,934 | 2/1962 | Bogater et al. | 217/60 |
| 4,087,883 | 5/1978 | Amdal | 16/82 |
| 4,253,689 | 3/1981 | McKee | 292/338 |
| 4,260,070 | 4/1981 | Pierson | 220/335 |

*Primary Examiner*—Allan N. Shoap
*Assistant Examiner*—Robert Petrik
*Attorney, Agent, or Firm*—Brown & Martin

[57] ABSTRACT

A safety latch for the hinged lid of an open-top container includes an elongated, curved latching bar secured at one end to the lid and extending through a bracket secured to the side of the container with a latching pin extending through one wall of the container and supported by the bracket and extending into selected ones of a plurality of notches along the curved face of the latching bar.

3 Claims, 5 Drawing Figures

SAFETY LATCH FOR HINGED LID

BACKGROUND OF THE INVENTION

The present invention relates to latches and pertains particularly to a latch for hinged closures for holding a closure in the open position.

Open-top containers having a hinged lid that is hinged to one edge of the open top and opens upward typically have latch means for holding the lid in the fully open position. Such latches however do not hold the lid to prevent it from closing under the weight of the lid once the latch is released. Such closures in some instances can become a hazard, especially when operated by small children.

Childen are frequently supplied with trunk-like toy boxes or chests that have an open top with a hinged lid pivoting upward about a horizontal axis. Many children have been injured by the falling lid of such chests. Other than expensive counterbalance lids, no means are available for preventing the accidental closure of such lids.

It is therefore desirable that some latch means be available for preventing the accidental sudden closing of hinged lids.

SUMMARY AND OBJECT OF THE INVENTION

It is therefore the object of the present invention to provide an improved latch for latching lids in an open position.

In accordance with the primary aspect of the present invention, a latchable support bracket for holding a lid in selected open positions includes an elongated latching bar having a plurality of notches along one surface thereof for attaching at one end to a lid and extending through a bracket secured to the wall of a container, and a latch pin supported by the bracket for selective engagement with a plurality of notches along the length of the latching bar.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
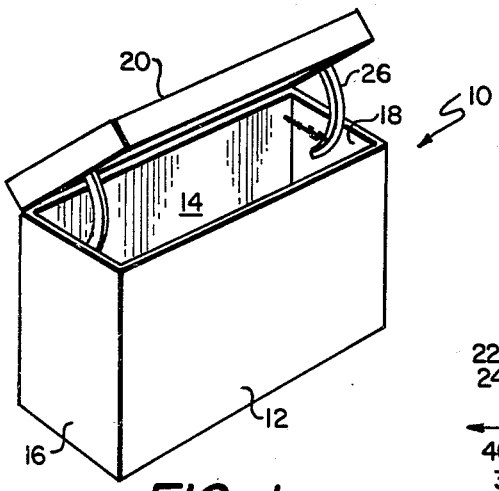
FIG. 1 is a perspective view of a typical open-top chest showing the safety latch installed.

Turning to FIG. 1 there is illustrated a box-like, open-top container such as a trunk or chest designated generally by the numeral 10 and having front and back walls 12 and 14 and end walls 16 and 18. A lid or closure 20 is hingedly mounted by a hinge member 24 to the top edge of the back wall 14 for pivotal movement about a horizontal axis. This is a typical construction arrangement for many trunks, toy chests, tool chests and many other such containers. The lid typically closes under its own weight when not held by some latch or other means in its open position.

Figure 2:
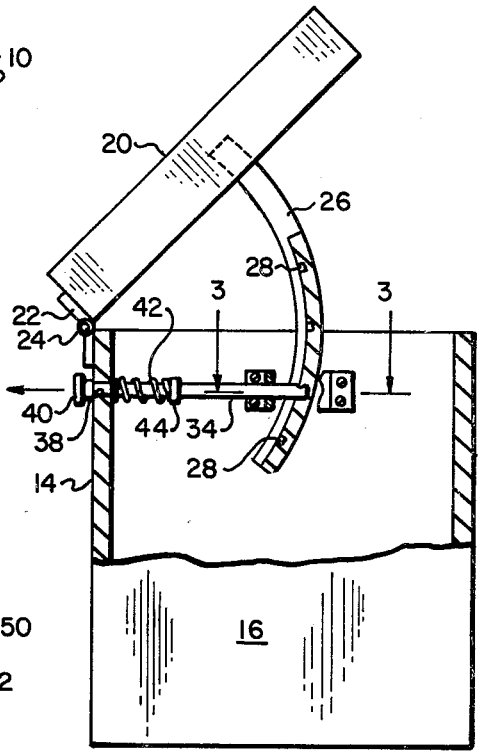
FIG. 2 is a side elevation view with portions shown in section 2 illustrate detail.

The latch of the present invention comprises an elongated arcuate-shaped latch bar or channel 26 as best seen in FIG. 2 which is secured at its upper end to the lid 20. The latch bar 26 is preferably fixed at the upper end to the lid 20, but in many instances may be pivotally connected thereto and appropriately guided by a guide bracket or the like.

The hinge bar or latch bar 26 is of a generally channel-shape having the channel on the inside of the curve toward the axis thereof. The curvature of the bar is such that its center of axis or center of curvature coincides substantially to the pin axis 24 of the hinge 22 of the lid. With this arrangement, the latch bar 26 follows a precise path along the wall of the chest or container. The latch bar 26 is provided in its inner surface within the groove of the channel with a plurality of notches 28. These notches are formed on the inner surface of or inner surface facing toward the hinge and the back of the chest or container.

Figure 3:
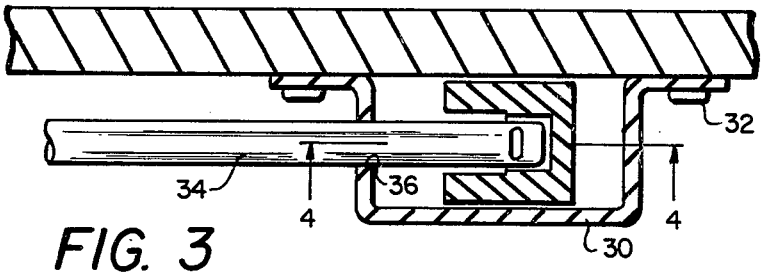
FIG. 3 is a section view taken generally on line 3—3 of FIG. 2.
Figure 4:
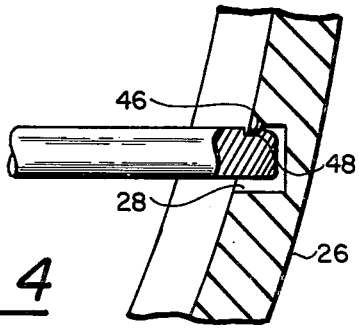
FIG. 4 is a enlarged detail view of the latch pin and notch engagement.

As best seen in FIG. 3, a generally U-shaped latch bracket 30 extends around and is secured by screws 32 or the like to the side wall of the chest. The bracket extends around and guides the latch bar 26 in its travel along the side of the chest.

An elongated latch pin 34 extends through and is supported by a bore 36 within the guide bracket 32 and through bore 38 in the back wall 14 of the chest 10.

A handle or knob 40 is secured to the outer end of the latch pin 34 at the back and outside of the box. The positioning of this handle or knob 40 contributes to the safety feature of the latching support bracket by requiring that one reach to the back of the chest or container to release the latch.

A spring 42 engages a shoulder 44 on the latch pin 34 and the wall 14 of the housing for biasing the latch pin into a selected one of the plurality of notches 28 in the latch bar 26.

The forward end of the latch pin 34 that extends into the notches 28 includes a notch 46 formed on the upper surface thereof which is engageable by a tooth 48 formed at the top forward edge of the notch or socket 28. This locks the latch pin 34 into position such that a positive force is needed to pull the pin from the socket, thus releasing the lid.

Figure 5:
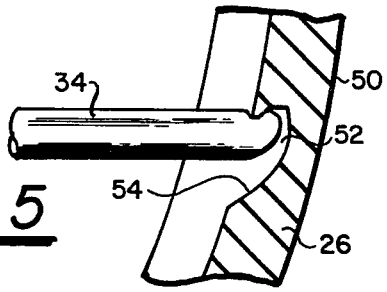
FIG. 5 is a view like FIG. 4 of an alternate embodiment.

Turning to FIG. 5, an alternate embodiment of the latching pin and notch is illustrated. In this embodiment, a latch bar 50 is provided with notches 52 having a sloped lower surface 54 for camming the pin 34 out of the notch upon opening the lid. This permits the lid to be opened without the necessity of pulling the latch pin 34 out of the notch and holding it in the retracted position until the necessary notch is engaged. Thus the lid can be lifted to the desired height and permitted to catch on the respective notch.

Upon closing the lid, one must reach behind the box and grasp the latch pin handle 40 and pull it outward to disengage the latch pin from the respective latching notch. This permits the lid to fall under its own weight to the closed position. The positioning of the latch handle 40 insures that the person must positively release the lid in order to secure its closing. This insures that the person closing the lid will be either conscious of the closing or will be in a position such that the lid will not fall on him. Thus, the lid will be positively held in an open position until its closing is desired.

While the illustrated latch is illustrated and described in terms of an open-top container, the latch can be applicable to vertically pivoting closures and the like. This can be applied to vault doors, refrigerator doors and other similar closures. This would reduce the accidents associated therewith.

While I have illustrated and described my invention by means of specific embodiments, it is to be understood that numerous changes and modifications may be made therein without departing from the spirit and scope of the invention as defined in the appended claims.

I claim:

1. The combination of an open top container having a closure hinged to a top edge of a back wall thereof for pivoting about a horizontal axis and a closure support bracket for supporting said hinged closure in the open position comprising:

an elongated latch bar curved about an axis in the direction of the pivot axis of the closure having a series of spaced notches along the one surface toward the axis and attached to the closure member;

a guide bracket attached to a side wall adjacent the open top of the housing for receiving and guiding said elongated bar; and an elongated latch pin having a forward end and an outer end and a handle on said outer end exterior of at the back of said container, said latch pin extending through said back wall and supported by said back wall and said guide bracket and including spring means for biasing said forward end of said pin into engagement with said one surface of said latch bar for selective latching engagement with said notches on said latch bar.

2. The support bracket of claim 1 wherein said notches each include a raised tooth at the edge thereof; and said latch pin includes a notch adjacent the notch engaging end thereof for engagement by said tooth.

3. The combination of an open top container having a closure hinged to a top edge of a back wall thereof for pivoting about a horizontal axis and a closure support bracket for supporting said hinged closure in the open position comprising:

an elongated bar curved about an axis in the direction of the pivot axis of the closure having a series of spaced notches along the one surface toward the axis and attached to the closure member, said notches each include a raised tooth at the edge thereof, said elongated bar is shaped to define a channel along said one surface, a guide bracket attached to a side wall adjacent the open top of the housing for receiving and guiding said elongated bar, an elongated latch pin having a handle exterior of said container extending through said back wall and supported by said back wall and said guide bracket and including spring means for biasing said pin into engagement with said one surface for selective latching engagement with said notches, said latch pin includes a notch adjacent the notch engaging end thereof for engagement by said tooth, and said latch engaging end of said pin is confined in said channel.

* * * * *